US007063090B2

(12) United States Patent
Wang et al.

(10) Patent No.: US 7,063,090 B2
(45) Date of Patent: Jun. 20, 2006

(54) MULTI-FUNCTIONAL HAIR-DYEING COMB STRUCTURE

(75) Inventors: Jang Chang Wang, Taipei (TW); Keng Hsin Liu, Taipei (TW)

(73) Assignee: Jonder Industries Ltd., Taipei (TW)

( * ) Notice: Subject to any disclaimer, the term of this patent is extended or adjusted under 35 U.S.C. 154(b) by 230 days.

(21) Appl. No.: 10/782,892

(22) Filed: Feb. 23, 2004

(65) Prior Publication Data

US 2005/0183736 A1 Aug. 25, 2005

(51) Int. Cl.
*A45D 24/00* (2006.01)

(52) U.S. Cl. ..... 132/119.1

(58) Field of Classification Search ..... 132/119.1, 132/112, 115; 15/22.1; 401/140, 277, 189, 401/190

See application file for complete search history.

(56) References Cited

U.S. PATENT DOCUMENTS 4,958,647 A * 9/1990 Busch et al. ..... 132/119.1
5,622,192 A * 4/1997 Chiou ..... 132/112
5,927,290 A * 7/1999 Thiruppathi ..... 132/116

* cited by examiner

*Primary Examiner*—John J. Wilson
*Assistant Examiner*—Robyn Doan
(74) *Attorney, Agent, or Firm*—Leong C. Lei

(57) ABSTRACT

Multi-functional hair-dyeing comb structure is disclosed. The comb structure has a housing having a detachable combing teeth seat with a liquid sac. The liquid sac contains dye for dyeing hairs, which is discharged by an electron's motor and are evenly discharged.

12 Claims, 10 Drawing Sheets

MULTI-FUNCTIONAL HAIR-DYEING COMB STRUCTURE

BACKGROUND OF THE INVENTION (a) Technical Field of the Invention

The present invention relates to comb structure, and in particular, a comb structure which can function as a comb for dyeing hair.

(b) Description of the Prior Art

FIGS. 8 and 9 depict a conventional comb structure having a combing disc 70 and a handle 80. The combing disc 70 is made of hard material and the center thereof is a cavity 71 having an opening at one end mounted with a connector. One flat side face of the combing disc 70 upward extends to form a hollow binding tube 72 which is used to discharge hair dye and is also used to comb hair. On the top of the hollow binding tube 72, a hood 74 is mounted so as to seal the opening of the hollow binding tube 72.

The handle 80 has a chamber 81 contained an air sac 90. One end of the air sac 90 is an outlet for the end portion of the handle 80 to protrude out, and a connector 82 is mounted thereto.

In dyeing hair, the handle 80 and the combing disc 70 are separated and a dyeing agent 91 is poured to the hollow cavity 71 from the connector 73, after that the combing disc 70 and the handle 80 are connected with the connector 73 (82). The hood 74 is then opened, as shown in FIG. 10, press the air sac 90 protruded from the handle 80 and the hair dye 91 is discharged via the opening of the binding tube 72. The hairs are dyed and combined.

The drawbacks of the conventional comb are as follows:

1. There are residues on the combing disc after the hair dyes are being used, and cleaning of the combing disc is troublesome, and dandruff will block the binding tube.
2. The combing disc cannot be used for dyes of different color.
3. Squeezing the air sac will not evenly discharge the dyes and therefore the quality of dyeing is poor.
4. If the opening of the binding tube is too large, a large paste of dye is discharged and may stick onto the hair, which may not be able to clean off easily.
5. The combing teeth of the conventional comb are not dense and therefore the combing treatment is poor.

SUMMARY OF THE INVENTION

Accordingly, it is an object of the present invention to provide a multi-functional hair-dyeing comb structure having an elongated housing containing a chamber with an installation slot at the upper portion thereof, a hole being formed between the chamber and the installation chamber and a guiding rod formed at the hole, characterized in that one end of the housing is a control chamber having a press switch, and a motor is provided at the chamber connected to the press switch, and the other end of the housing is a main shaft gear connected to a transmission gear module; and a rotating disc is mounted at the external of the guiding rod, and the circumferential edge is provided with teeth in engagement with the transmission gear module; and a press disc mounted onto the guiding rod urging the rotating disc, and the external side face of the combing teeth seat is at least is a main binding tube having a hollow opening; and the inner side face of the combing teeth seat is provided with a liquid sac and the combing teeth seat is mounted within the installation slot of the housing; whereby when the press switch is pressed, the transmission gear module drives the rotating disc to push the press disc moving along the guiding rod, and the press disc urges the liquid sac so that the dyeing agent is evenly squeezed out.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
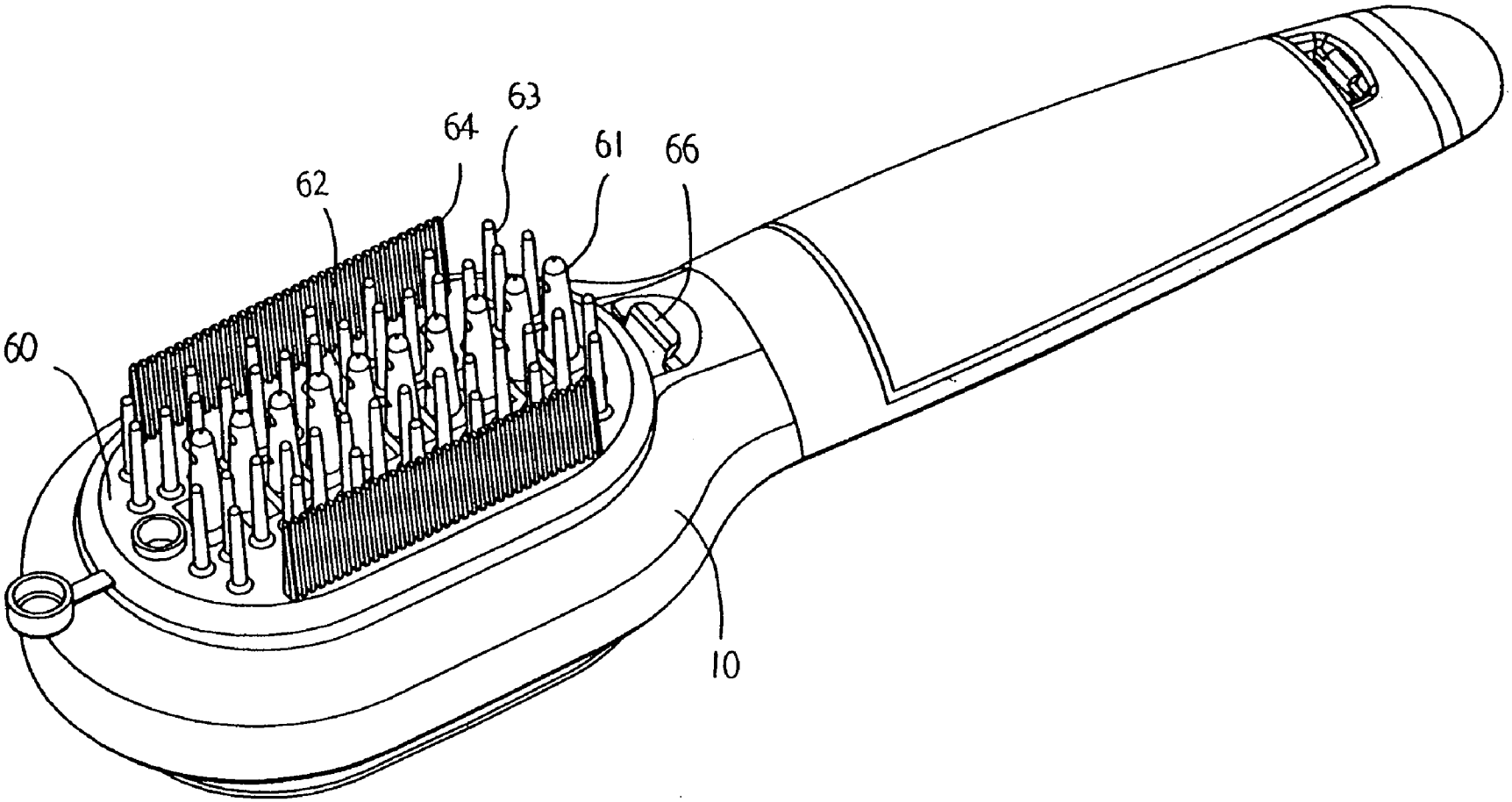
FIG. 1 is a perspective view of the present invention.
Figure 2:
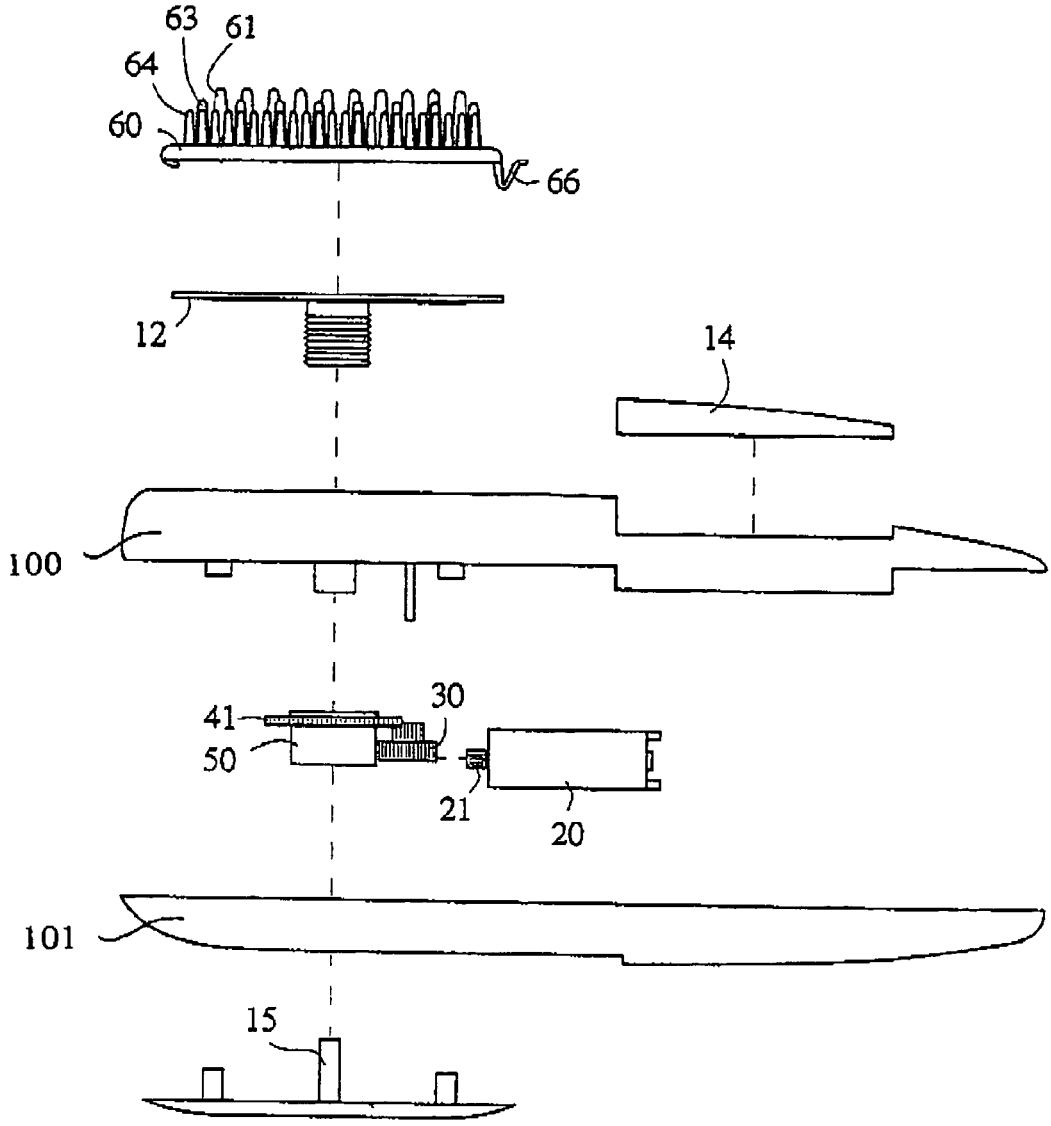
FIG. 2 is an exploded view of the present invention.
Figure 3:
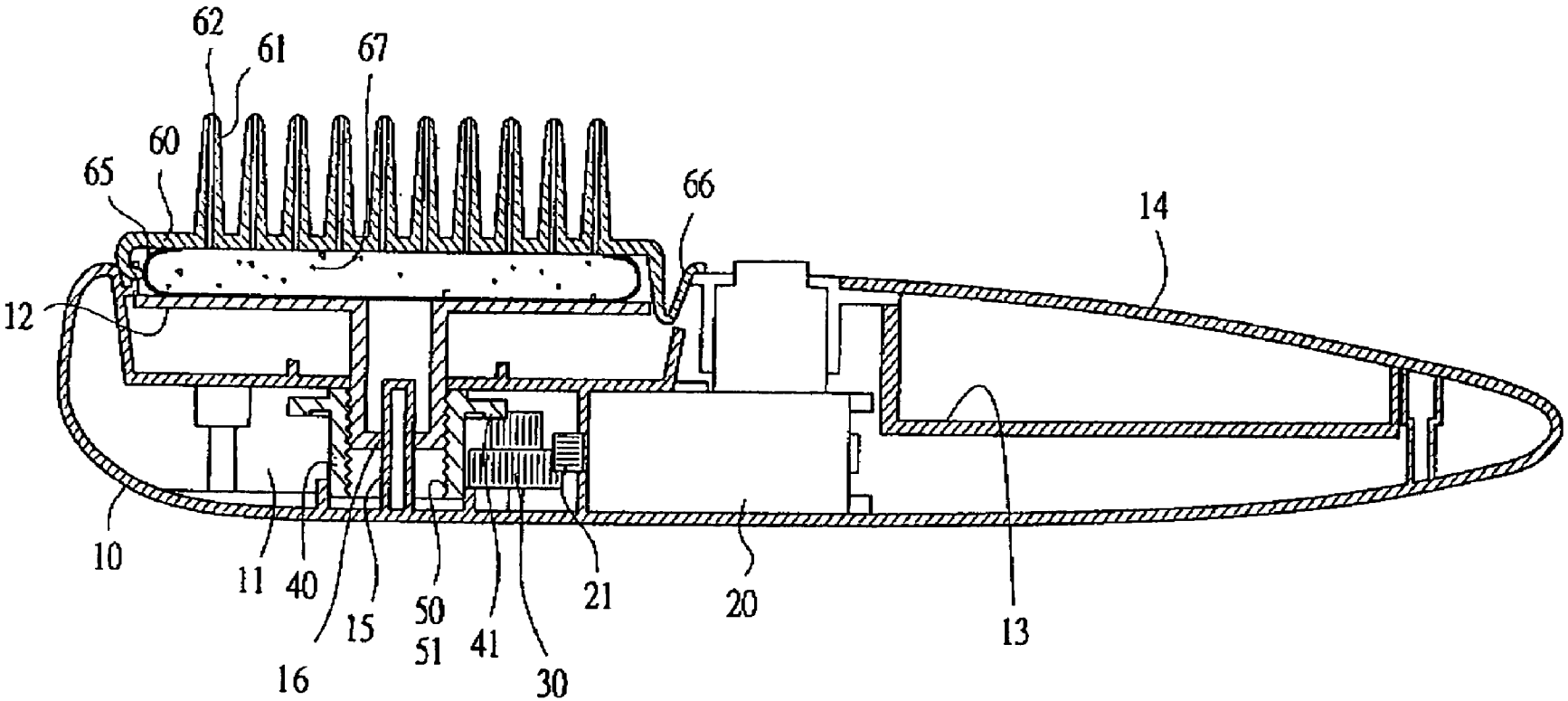
FIG. 3 is an exploded sectional view of the present invention.

Referring to FIGS. 1, 2, and 3, there are shown a hair-dyeing comb having an elongated housing 10, as shown in FIG. 3. The housing 10 is formed from two sides plates 100, 101 and a chamber 11 is provided to the housing 10. The top portion of the chamber 11 is an installation slot 12 and a hole 16 is provided between the chamber 11 and the installation slot 12. A guiding rod 15 is provided at the hole 16, and the other end of the housing 10 is a control chamber 13 having mounted with a press switch 14.

A motor 20 is positioned in the chamber 11 having one end connected to the press switch 14 of the control chamber 11. The main shaft gear 21 at the other end of the control chamber 13 is connected to a transmission gear module 30.

A rotating disc 40 is mounted externally to the guiding rod 15 and the circumferential edge is provided with teeth 41 which is in engagement with the gear module 30.

The end portion of a press disc 50 is a push face 51 and the other two ends are mounted onto the guiding rod 15 and urges the rotating disc 40.

A combing-teeth seat 60 has the size of the installation slot 12 of the housing 10, and the external side face is provided with at least a main binding tube 61, dense combing teeth 63, and very dense combing teeth 64. The opening 62 of the main binding tube 6 is at the side of the outer ends and the inner side face of the combing-teeth seat 60 is a liquid sac 65, and a dyeing agent 67 is contained in the liquid sac 65. The combing-teeth seat 60 has at least one side mounted with an elastic button 66 such that the combing teeth seat 60 can be snapped on to the installation slot 12 of the housing 10 by the elastic button 66.

Figure 4:
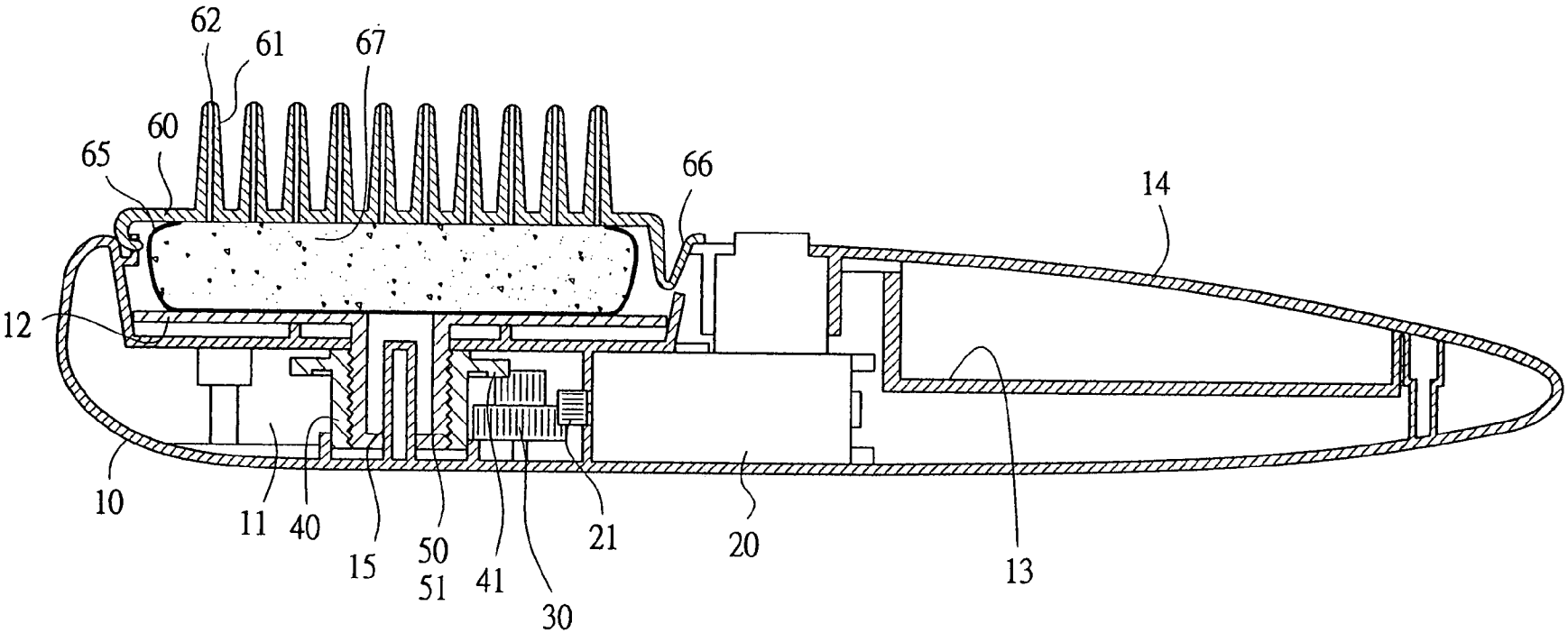
FIG. 4 is a sectional view of the present invention.

Referring to FIGS. 3, and 4, when in application, the press switch 14 of the housing 10 is depressed, the motor 20 is initiated and by means of the transmission gear module 30, the press disc 50 of the rotating disc 40 is driven to move along the guiding rod 15, and the push face 51 of the press disc 50 urges the liquid sac 65 of the installation slot such that the dyeing agent 67 within the liquid sac 65 is squeezed out from the opening 62 at the end portion of the main binding tube 61. Thus, the flowrate of the dyeing agent can be controlled and will not be dropped onto the root of the hairs.

Figure 5:
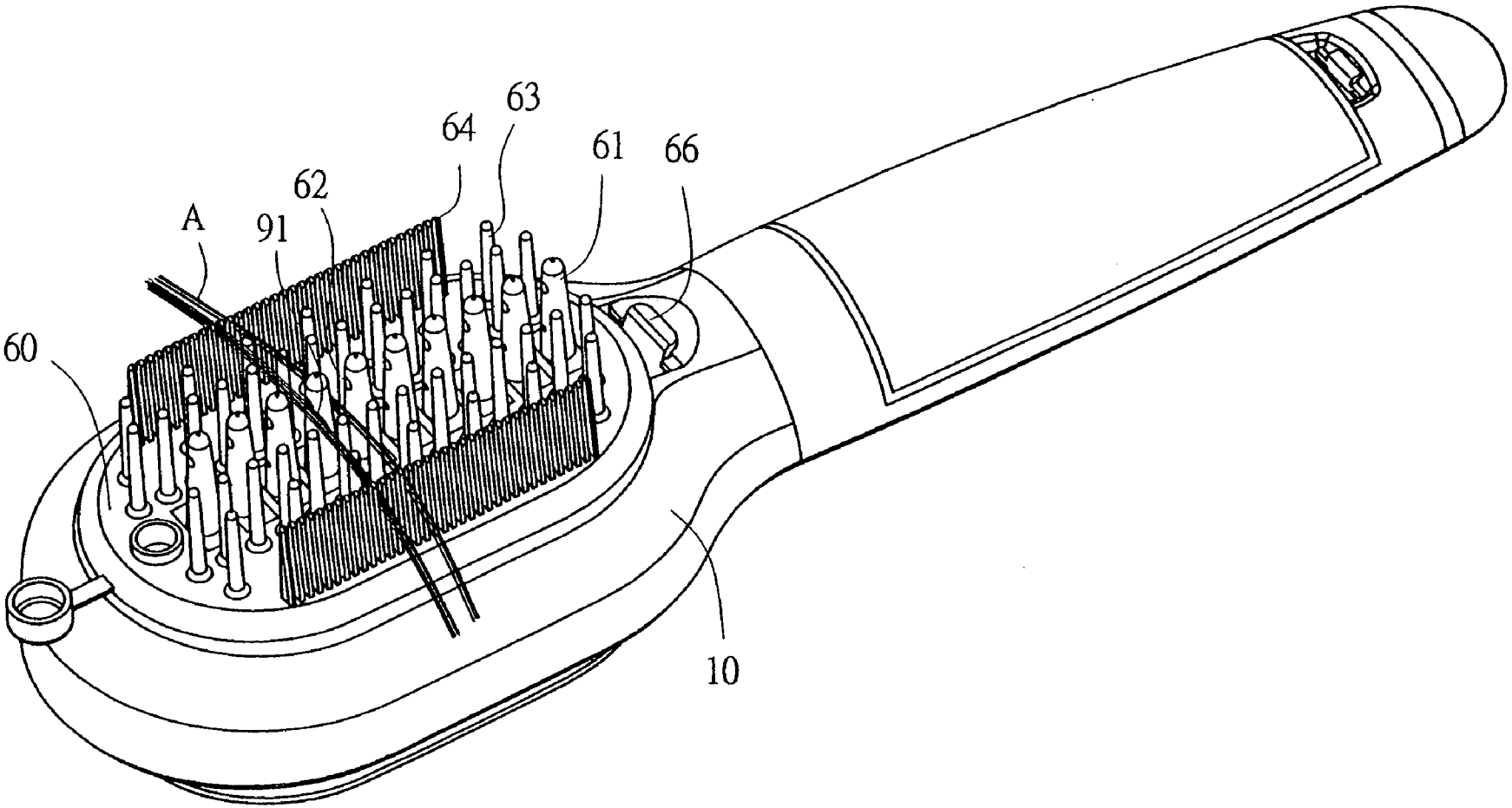
FIG. 5 is a schematic view showing the discharging of dye in accordance with the present invention.
Figure 6:
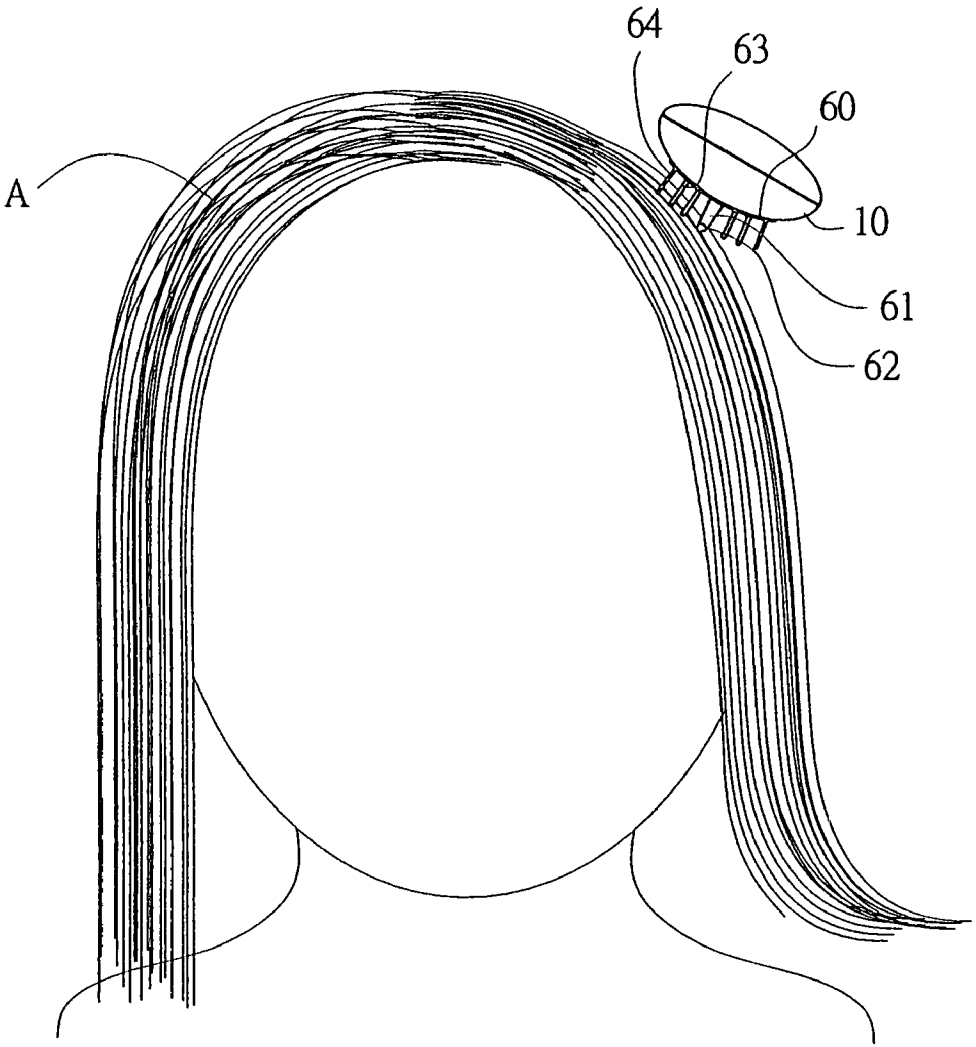
FIG. 6 is a schematic view showing dyeing, supporting and combing using the comb of the present invention.

Referring to FIGS. 1, and 5, the opening 62 are in pair, and are in the axial direction of the main binding tube 61. When hairs A are combined between the main binding tube 61, the dyeing agent 67 directly dyes the hair A and will not drop. Referring to FIG. 6, the hairs A are dyed at the main binding tube 61 and are supported by the dense combing teeth 63 and are combed by the very dense combining teeth 64. Thus, the hairs A are dyed, supported and treated.

Figure 7:
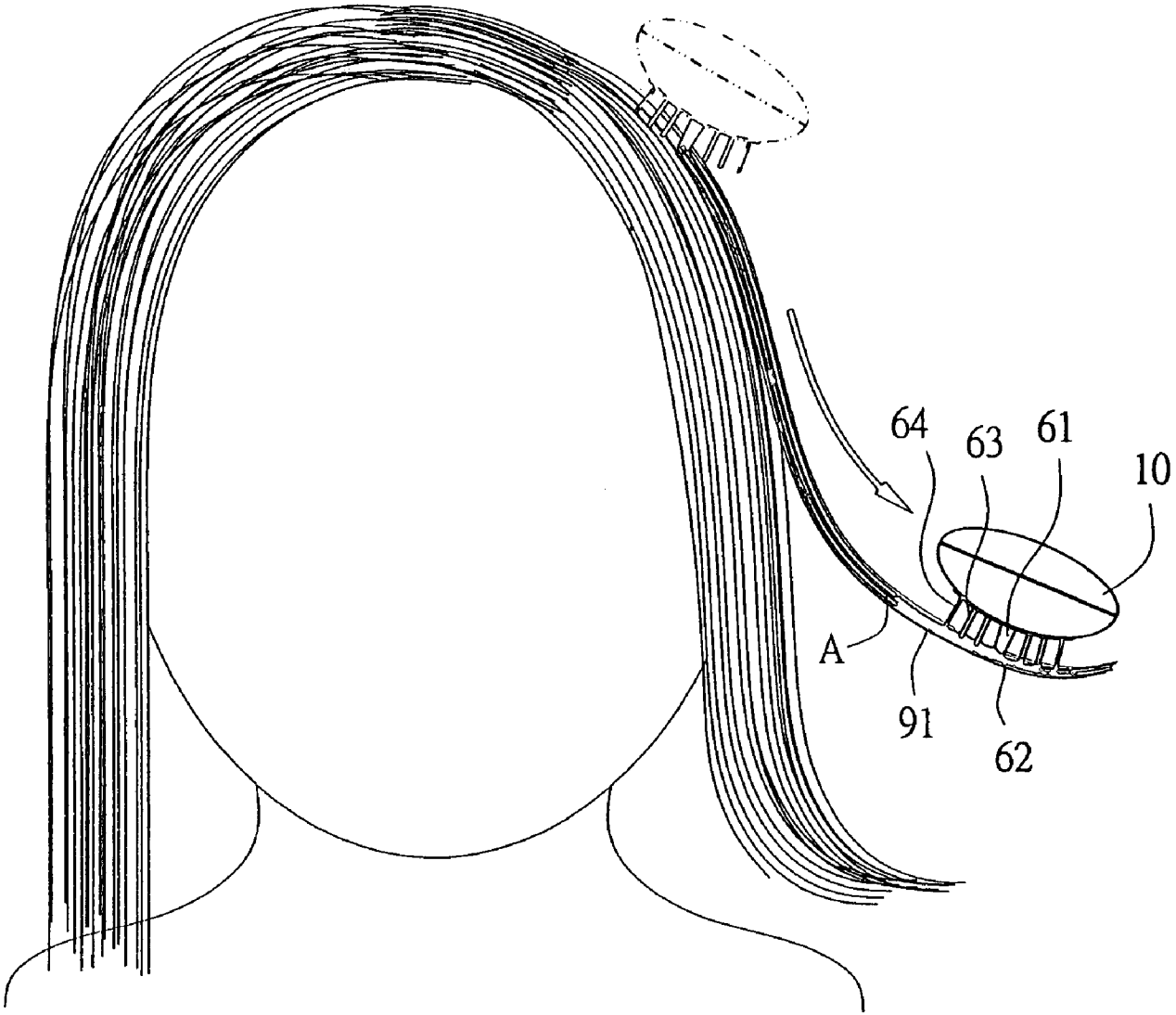
FIG. 7 is a schematic view showing the application of the comb in accordance with the present invention.
Figure 8:
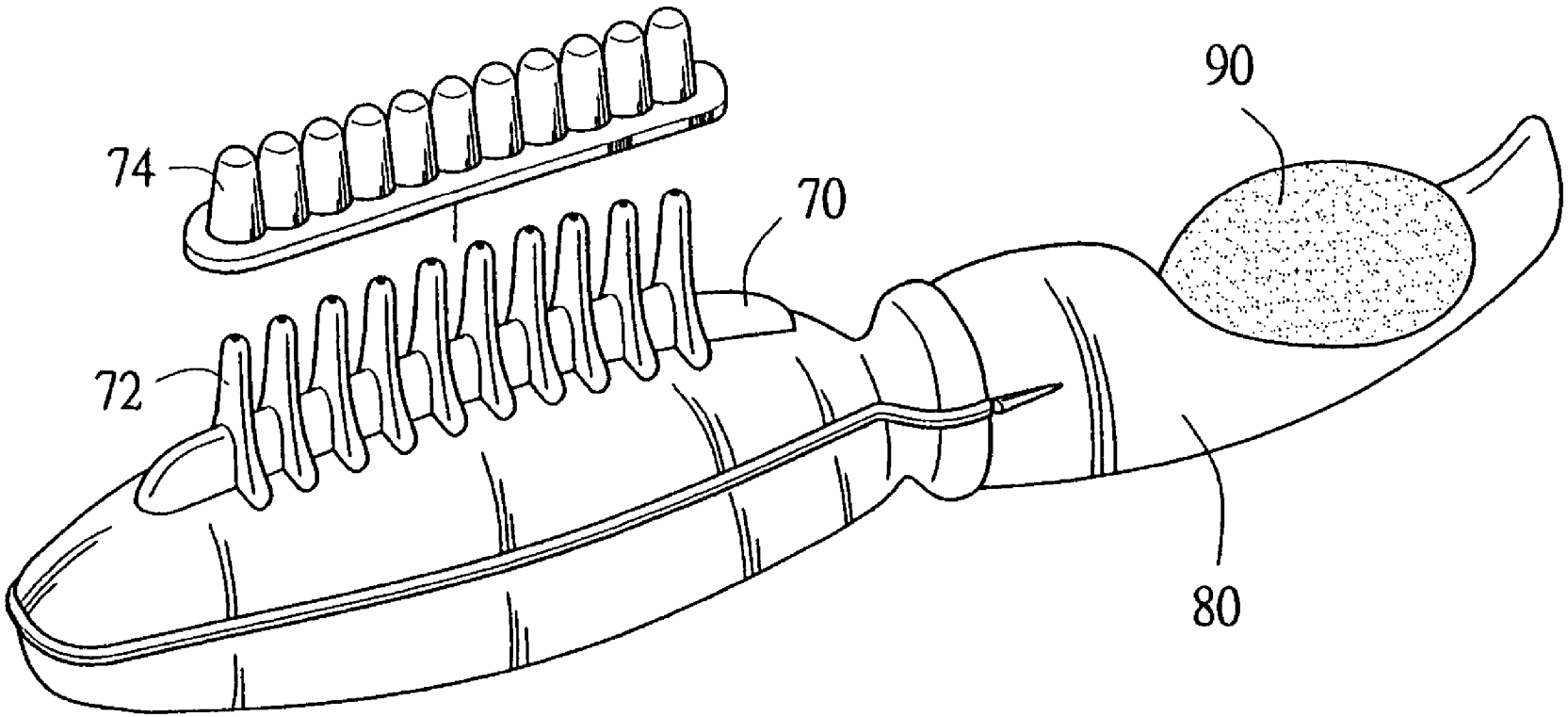
PRIOR ART FIG. 8
FIG. 8 is a perspective view of a conventional comb structure.
Figure 9:
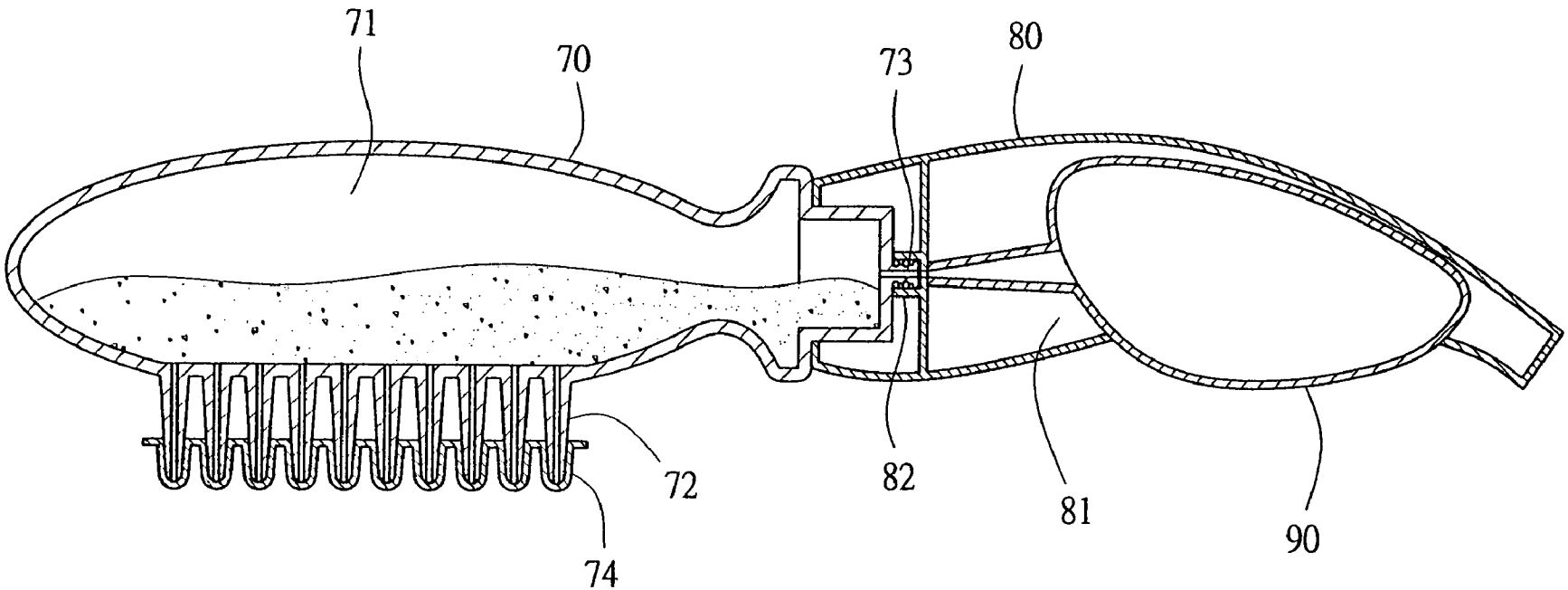
PRIOR ART FIG. 9
FIG. 9 is a sectional view of the conventional comb structure.
Figure 10:
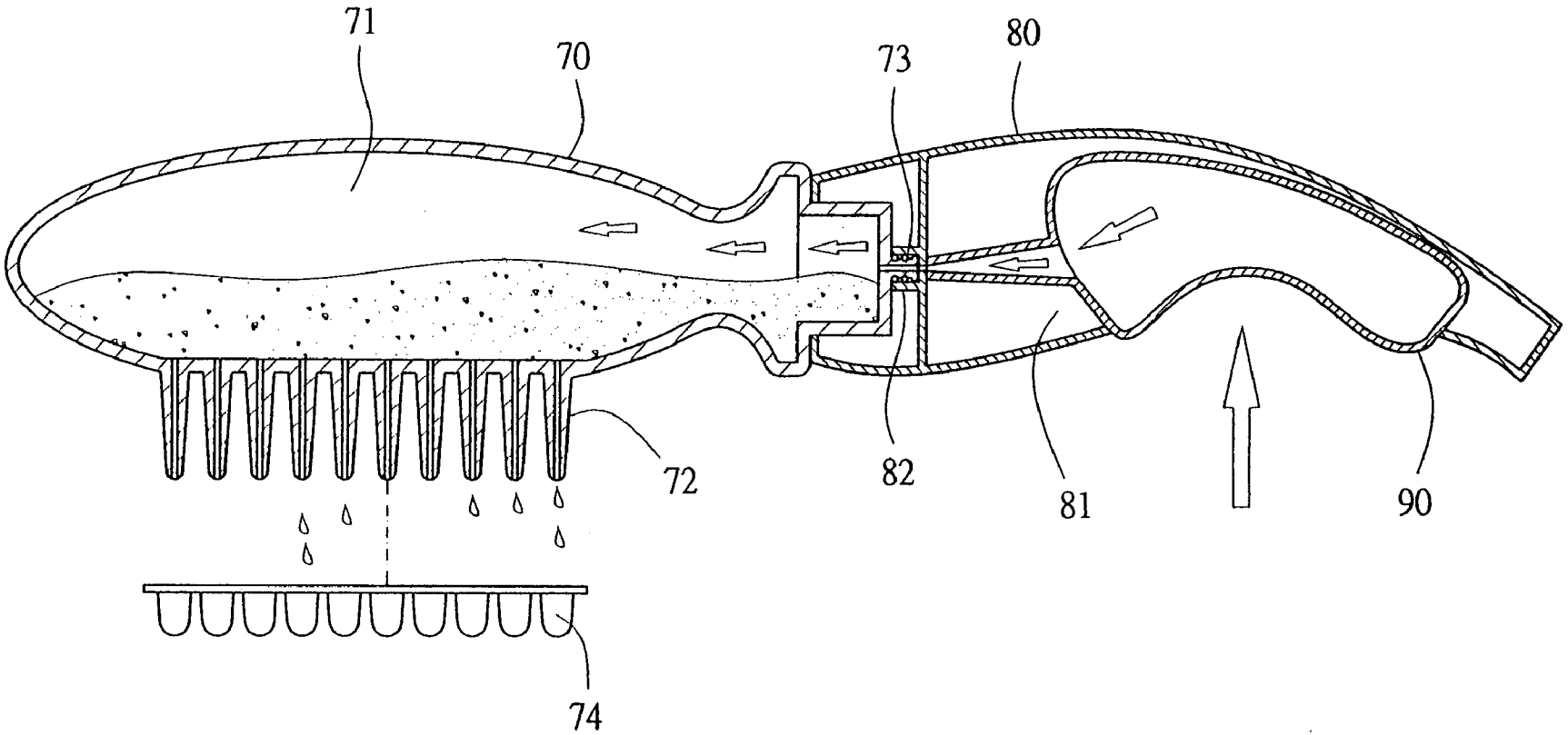
PRIOR ART FIG.10
FIG. 10 is a sectional view showing the action of the conventional comb structure.

Referring to FIG. 7, the lengths of the main binding tube 61, dense combing teeth 63 and the very dense combing teeth 64 are in from the largest length to the shortest or the ends are in arch-shaped. For each dyeing, the hairs A are first dyed at the main binding tube 61, via the dense combing teeth 63 and the very dense combing teeth 64, and the arch shape conforms to the profile of the head.

The advantages of the present invention are

1. When dyeing agent has been used up, the combing teeth seat having a liquid sac can be detached and replaced. The problem on residue will not occur.
2. As the rotating speed of the transmission gear driven by the motor is at a constant speed, the press disc squeezes the liquid sac evenly and the force exerted is even, and the dyeing process is smooth. Thus, the dyeing of hair is smooth.
3. The comb structure allows free use of dyes of different color.
4. The interior of the main binding tube will not be blocked easily.
5. The opening of the main binding tube is at the side of the end portion thereof, and therefore, the dye discharged is rather even, and will not drip onto the root of the hair. Further, the flowrate of dye can be easily controlled.
6. The combing-teeth seat of the present invention can be used as a comb.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. A multi-functional hair-dyeing comb structure having an elongated housing containing a chamber with an installation slot at the upper portion thereof, a hole being formed between the chamber and the installation chamber and a guiding rod formed at the hole, characterized in that one end of the housing is a control chamber having a press switch, and a motor is provided at the chamber connected to the press switch, and the other end of the housing is a main shaft gear connected to a transmission gear module; and a rotating disc is mounted at the external of the guiding rod, and the circumferential edge is provided with teeth in engagement with the transmission gear module; and a press disc mounted onto the guiding rod urging the rotating disc, and an external side face of a combing teeth seat is at least is a main binding tube having a hollow opening; and the inner side face of the combing teeth seat is provided with a liquid sac and the combing teeth seat is mounted within the installation slot of the housing; whereby when the press switch is pressed, the transmission gear module drives the rotating disc to push the press disc moving along the guiding rod, and the press disc urges the liquid sac so that the dyeing agent is evenly squeezed out.

2. The hair-dyeing comb structure of claim 1, wherein the opening of the main binding tube is at least positioned at the one side of the external end.

3. The hair-dyeing comb structure of claim 1, wherein the openings are positioned in pair.

4. The hair-dyeing comb structure of claim 1, wherein the opening is located at the axis of the main binding tube.

5. The hair-dyeing comb structure of claim 1, wherein the end portion of the press disc is formed into a push face.

6. The hair-dyeing comb structure of claim 1, wherein the housing is formed by two side plates.

7. The hair-dyeing comb structure of claim 1, wherein at least one side of the combing teeth seat is an elastic button.

8. The hair-dyeing comb structure of claim 1, wherein one side or two sides of the main binding tube is/are at least a row of dense combing teeth.

9. The hair-dyeing comb structure of claim 1, wherein one side or two sides of the main binding tube is or are at least a row of very dense combing teeth.

10. The hair-dyeing comb structure of claim 1, wherein one side or two sides of the main binding tube at one side or at two sides is or are provided with a row of dense combing teeth or very dense combing teeth.

11. The hair-dyeing comb structure of claim 1, wherein the lengths of the main binding tube, dense combing teeth and very dense combing teeth are in the sequence of longest length to the lowest length.

12. The hair-dyeing comb structure of claim 1, wherein the ends of the main binding tube, dense combing teeth and very dense combing teeth are in arch shaped.

* * * * *